US006059152A

United States Patent [19]

Mayfield

[11] Patent Number: 6,059,152

[45] Date of Patent: May 9, 2000

[54] TRIGGER SPRAY CONTAINER WITH INTEGRAL STRAW GUIDE

[76] Inventor: Todd A Mayfield, 4745 Winding Rose Dr., Suwanee, Ga. 30024

[21] Appl. No.: 09/045,766

[22] Filed: Mar. 20, 1998

[51] Int. Cl.[7] ..... B67D 5/40

[52] U.S. Cl. ..... 222/382

[58] Field of Search ..... 222/464.1, 383.1, 222/211, 382, 324; 239/333

[56] References Cited

U.S. PATENT DOCUMENTS

| | | | |
|---|---|---|---|
| 4,865,232 | 9/1989 | Cassady, Jr. et al. | 222/382 |
| 5,279,450 | 1/1994 | Witt, Jr. | 222/324 |
| 5,464,129 | 11/1995 | Ho | 222/382 |
| 5,638,994 | 6/1997 | Libit et al. | 222/382 |
| 5,875,940 | 3/1999 | Mayfield | 222/382 |

*Primary Examiner*—Philippe Derakshani

[57] ABSTRACT

A trigger spray container that prevents dry firing and solves the problem of interupted spray as the containers contents are dispensed and reduced to a level that allows the end of straw tip of trigger spray apparatus to become disengaged with liquid as the container is tilted towards the users target. As the user inverts or rotates the container from a vertical position, downwardly, towards a horizontal plain and aims the spray tip output nozzel towards the intended target, the liquid level adjusts within the container. Therefore, it becomes advantageous for end of straw tip to be positioned at the lowest point on container base, side of container base nearest target. This is achieved by forming an integral straw guide molded into the container body that provides a ramp for the straw to be guided on, thereby directing the straw tip to this position. The straw length of the trigger spray apparatus is of sufficient length such that it travels on ramp of integral straw guide and engages with intended base corner as trigger spray apparatus becomes securably attached to the mouth opening of container. The liquid contents of the container can now be fully consumed, without pumping air during operation, as the consumer uses the product in its entirety.

3 Claims, 3 Drawing Sheets

TRIGGER SPRAY CONTAINER WITH INTEGRAL STRAW GUIDE

CROSS REFERENCES TO RELATED APPLICATIONS

This patent application Ser. No. 09/045,766 is related to applicants U.S. Pat. No. 5,875,940, application Ser. No. 08/872,220, filed Jun. 10, 1997, for "Container With Integral Straw Guide."

BACKGROUND

1. Field of Invention

This invention relates to containers, especially containers or bottles suitable for holding and dispensing liquids, generally through an attachable dispensing device that is manually operated, such as a trigger spray apparatus that dispenses a stream or atomized fluid.

2. Description of Prior Art

Containers (generally plastic) that are specifically designed to receive dispensing devices like an attachable trigger spray apparatus, come in various geometrical shapes and capacities. Such containers like Des. 315,671 and Des. 330,515 are designed so a human being can grasp the container and pump a trigger spray mechanism comfortably with one hand. These types of containers are convenient and effective for dispensing various liquids such as; house-hold cleaning products, industrial solutions, automotive products, pet products and agricultural products. However, at least 90% of the time when using these products the container must be rotated downwardly from the vertical position towards a horizontal plane or inverted so that the spray tip output nozzel of dispensing apparatus can be positioned respectively towards the consumer's target. In doing so, liquid contents shift accordingly within the container. As the liquid contents are reduced inside the container the straw of dispensing device becomes disengaged with liquid when the container is in this position. Therefore, the consumer must frequently re-prime the dispensing system by returning the container to the vertical position and repeatedly squeeze the trigger spray apparatus to purge air out of the system, thus creating an inconvenience. This situation occurs usually when there is at least 30% of liquid still left in the container. Other attempts have been made to try and improve this field of art so that 100% of the product can be used. U.S. Pat. Nos. 5,279,450, Container With Two Seperate Chambers and 5,518,150, Multi-Chambered Container Having A Tube Insertion Guide Wall have attempted to solve this problem but unfortunately, still have problems when used in the most popular and desired dispensing positions.

The applications for liquid products in containers of the type require the consumer to rotate subject container from a vertical position, downwardly, to approximately 90 degrees or even past a horizontal plane to directly engage consumers intended target. It therefore becomes advantageous that straw tip of trigger spray dispensing apparatus be positioned internally at the lowest point on container base, side nearest intended target, when container is in desired position.

The problem with U.S. Pat. Nos. 5,279,450 and 5,518,150 are; they both have undesireable seperate chambers that interrupt communication between liquid and dispensing suction tube within the container. As these containers are rotated downwardly towards desired dispensing position, with spray tip output nozzel directed towards target, the liquid leaves smaller chamber where suction tube is and pours back into larger chamber. This permits air back into suction tube thereby, requiring dispensing system to be re-primed.

There remains a need for an effective container to dispense liquids in a horizontal or inverted position without having to re-prime the dispensing system. My present invention "Trigger Spray Container With Integral Straw Guide" provides a solution to this problem and enables the consumer to use 100% of liquid contents in the most popular and desired dispensing positions, without having to re-prime the trigger spray apparatus. The current invention has the ability to make it easier than applicants U.S. Pat. No. 5,875,940 to guide the straw of virtually all types of attachable trigger devices, to intended base corner of container.

OBJECTS AND ADVANTAGES

Accordingly, several objects and advantages of my invention are to prevent dry firing from occuring once the trigger spray apparatus has been primed. The new container solves the problem of interupted spray as the contents are reduced to a level that permits the end of straw tip of trigger spray apparatus to become disengaged with liquid as container is inverted or rotated from vertical position, downwardly, towards the users target. In this tilted position, the liquid level adjusts within the container respective to the angular rotatation induced by consumer for spray to reach the intended target. Thus it becomes advantageous for straw tip to be postioned at the lowest point of container base, at juncture of sidewall, side closest to target, so that the tip remains submerssed, allowing the contents to be consumed in its entirity without pumping air. This is achieved by forming a portion of sidewalls into a ramp whereby, the ramp angle is aligned with intended base corner, thus creating an integral straw guide. During assembly of the trigger spray apparatus to the container, the straw tip enters the sealable mouth opening of bottle and slides down the formed ramp as it is directed towards the lowest point of container base, side nearest spray nozzle or target.

Still further objects and advantages will become apparent from a consideration of the ensuing description and accompanying drawings.

REFERENCE NUMERALS

Figure 1:
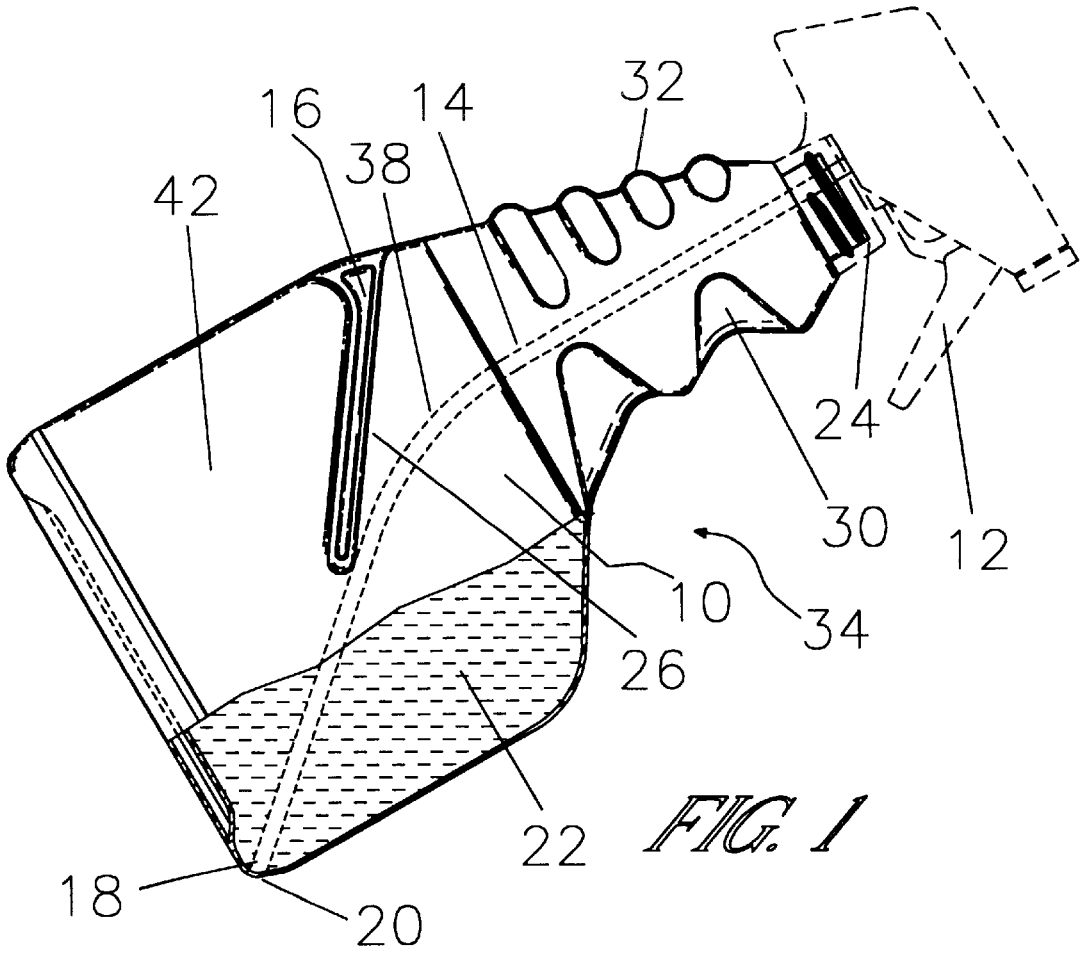
FIG. 1 is an assembly view of my invention shown in an inverted position.

10 container
12 trigger spray apparatus
14 straw
16 integral straw guide
18 straw tip
20 base corner
22 liquid
24 sealable mouth opening

26 ramp
28 mold parting line
30 finger gripping surfaces
32 non-slip gripping ribs
34 assembly
36 in-mold label ports
38 gradual radius
40 manual dispensing apparatus
42 lower containment body
44 fluid dispenser

SUMMARY

A trigger spray container produced from a moldable material suitable for holding and or dispensing liquids therefrom, comprising: an integral straw guide formed into a portion of container that guides straw of a trigger spray apparatus or other manual dispensing apparatus to intended base corner, as trigger spray apparatus becomes securably attached to the mouth opening of container, at least one sealable opening, a gripping area respectably sized for holding by a human being located beneath at least one sealable opening, whereby these features allow the liquid contents of container to be fully consumed, without pumping air during operation, even while inverted or rotated from a vertical position, downwardly, towards a horizontal plain so that spray tip output nozzel is directed towards target, allowing the consumer to use 100% of the liquid product contained.

PREFERRED EMBODIMENT—DESCRIPTION

As shown in FIG. 1, container 10 is in an inverted position with trigger spray apparatus 12 aimed at target (not shown) and illustrates how straw 14 is guided by ramp 26 of integral straw guide 16, forming gradual radius 38, as straw 14 is directed so that straw tip 18 of straw 14 is contacting base corner 20, allowing straw tip 18 to remain submerssed in liquid 22 at all times during operation, while trigger spray apparatus 12 is securably attached to sealable mouth opening 24. Ramp 26 of integral straw guide 16 is generally positioned in lower containment body 42 of container 10 and is formed as the mold sections come together and pinch the container material along mold parting line 28 (shown in FIG. 3).

In accordance with the invention, container 10 is conveniently designed for human hands (not shown) so that container 10 may easily be grasped or held comfortably with one hand. Although it is not necessary, container 10 (shown in FIG. 1), could provide finger gripping surfaces 30 and non-slip gripping ribs 32, or other means for improved comfort during operation.

Figure 2:
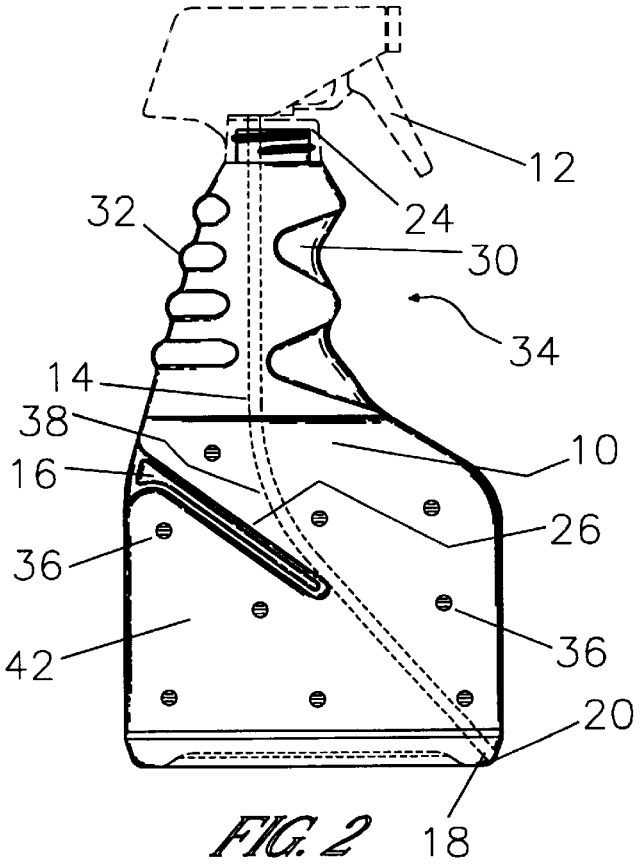
FIG. 2 is a front side view and shows how the new art can be positioned among circular in-mold label ports in the sidewalls of container body.

FIG. 2—front side view, shows assembly 34, comprised of trigger spray apparatus 12 and straw 14, securably attached to sealable mouth opening 24, of container 10.

Figure 3:
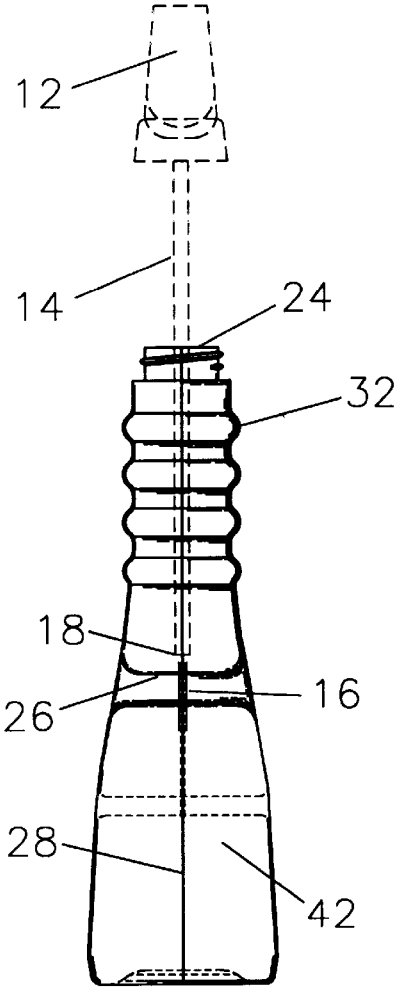
FIG. 3 is a left end view of FIG. 2 and shows a trigger spray apparatus with straw being inserted through sealable mouth opening.

The end view in FIG. 3 shows ramp 26 of integral straw guide 16 along mold parting line 28 and demonstrates how straw 14 is received and guided into position as trigger spray apparatus 12 (FIG. 1) becomes securably attached to sealable mouth opening 24 of container 10.

Figure 4:
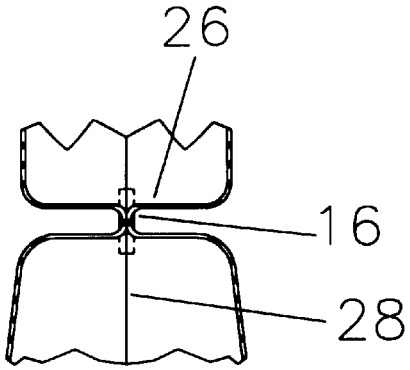
FIG. 4 is a view in detail of the portion indicated by section lines 4—4 as shown in FIG. 5.
Figure 5:
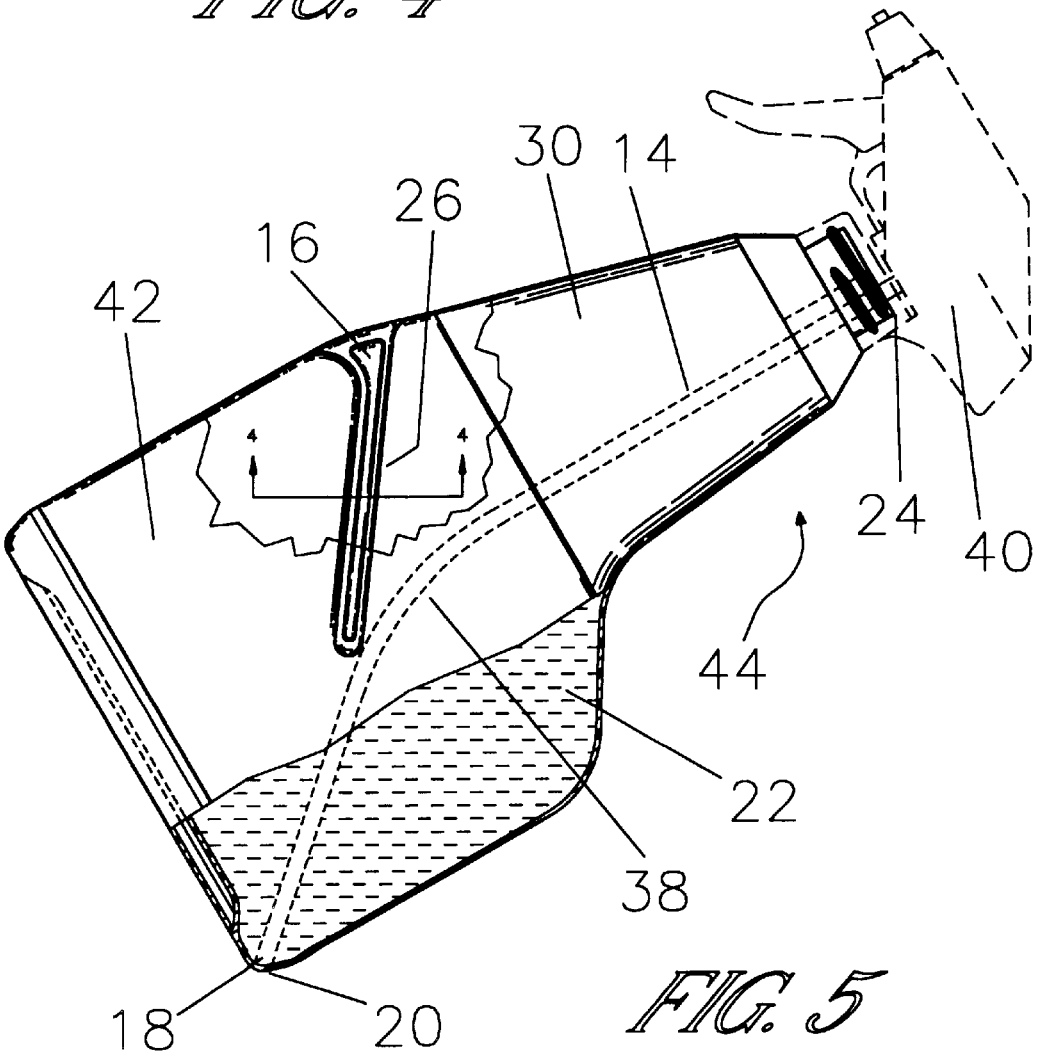
FIG. 5 shows a front side view of my fluid dispenser tilted from a vertical position, illustrating manual dispensing apparatus with nozzel rotated 180 degrees for dispensing overhead.

FIG. 4—is a view in detail indicated by section lines 4—4 in FIG. 5, and shows a cross-sectional area of ramp 26 of integral straw guide 16 that directs straw tip 18 of straw 14 to intended base corner 20.

FIG. 5—front side view, shows fluid dispenser 44 tilted from a vertical position, with manual dispensing apparatus 40 rotated 180 degrees for disepensing overhead and securably attached to sealable mouth opening 24, whereby straw tip 18 of straw 14 is directed by ramp 26 of integral straw guide 16, to intended base corner 20 of lower containment body 42.

PREFERRED EMBODIMENT—OPERATION

Operation and use of the invention is simple and straightforward. As container 10 or fluid dispenser 44 are being produced with moldable material (generally high density or low density polyethlene or other plastic material) through a blow molding process, ramp 26 of integral straw guide 16 is formed as the mold sections close together and seat. When the mold sections are clamped in the seated position, air is blown into the cavity of the mold and forces the parison or plastic material to the outer confines of the mold. Upon contact of the mold cavity walls, the plastic material cools, and container 10 or fluid dispenser 44 are formed with integral straw guide 16. In-mold label ports 36 are sometimes used for improved labeling characteristics. In this event ramp 26 of integral straw guide 16 will be positioned accordingly, so as not to interfere with the functionality of in-mold label ports 36.

As straw 14, of trigger spray apparatus 12 or manual dispensing apparatus 40, is inserted through sealable mouth opening 24, straw 14 is directed by ramp 26 of integral straw guide 16. As straw 14 passes along ramp 26 of integral straw guide 16 it bends straw 14 forming gradual radius 38 as straw 14 changes directions and moves towards base corner 20 of lower containment body 42. Straw 14 of trigger spray apparatus 12 or manual dispensing apparatus 40 is of adequate length such that straw tip 18 makes contact with base corner 20, located opposite side from integral straw guide 16 as trigger spray apparatus 12 or manual dispensing apparatus 40 is seated and attached to sealable mouth opening 24 of container 10 or fluid dispenser 44.

The upper portion of container 10 and fluid dispenser 44, below sealable mouth opening 24, are designed so that they can be easily and comfortably grasped by human hands. Non-slip gripping ribs 32 and finger gripping surfaces 30 or other means can improve hand fatigue during extended operation of trigger spray apparatus 12. However, other embodiments such as fluid dispenser 44, depending upon product applications may omit non-slip gripping ribs 32 and finger gripping surfaces 30 and provide an alternate gripping area respectably sized for holding by a human being, yet not depart from the main scope of the invention.

CONCLUSIONS, RAMIFICATIONS, AND SCOPE

Accordingly, it can be seen that the invention offers distinct advantages over existing trigger spray containers. The new container solves the problem of interupted spray as containers contents are dispensed to a level that allows the straw tip to become disengaged with liquid as the container is tilted towards the users target. The integral straw guide directs the straw of the trigger spray assembly to base corner of container body (side opposing straw guide) thereby holding straw in an optimum position so that entire contents can be consumed without pumping air, even when the container is in an inverted position. The integral straw guide can be molded into the container body through conventional blow molding processes, yet is economical to fabricate, reliable and easily recieves the intended straw of trigger spray apparatus.

Although the description above contains many specificities, these should not be construed as limiting the scope of the invention but as merely providing illustrations of some of the presently preferred embodiments of this invention. Various other embodiments and ramifications are possible within it's scope. For example, shapes, sizes and capacities of the container may vary depended upon the product application, therewith positioning and location of the integral straw guide.

Thus the scope of the invention should be determined by the appended claims and their legal equivalents, rather than by the examples given.

What is claimed is:

1. A container produced from a moldable material suitable for filling, holding and or dispensing liquids therefrom, comprising:

a) at least one sealable opening, and having an integral gripping means located beneath at least one sealable opening, whereby said gripping means is sized so that a human being can hold said container, b) said container having a containment body adjoining said gripping means, whereby said containment body is formed with a singular chamber having a section of inwardly projecting wall portions defining a ramp, creating an integral straw guide, c) said ramp of integral straw guide is molded into section of said containment body sloping downwardly towards a base corner of said containment body.

2. A container of claim 1 wherein said ramp of said integral straw guide is positioned to receive straw of a trigger spray apparatus and guide tip of said straw to said base corner of said containment body so that said straw tip will remain submersed in liquid even when said container is inverted or rotated towards a horizontal plain.

3. A fluid dispenser suitable for containing a liquid having a least one sealable opening, a means for a human being to hold said fluid dispenser with one hand, whereby said fluid dispenser comprises:

a) a containment body having a singular chamber with a section of inwardly projecting wall portions defining a ramp, creating an integral straw guide that slopes downwardly for a distance towards a base corner of said containment body, b) whereby a manual dispensing apparatus is securably attached to said sealable mouth opening of said fluid dispenser, c) said manual dispensing apparatus having a straw of sufficient length to be directed along said ramp of said integral straw guide, and have first open end of said straw engage with said base corner of said containment body and second end of said straw to communicate with said manual dispensing apparatus for atomizing or dispensing a stream of fluid therefrom.

* * * * *